United States Patent [19]

Maki et al.

[11] Patent Number: 4,573,817

[45] Date of Patent: Mar. 4, 1986

[54] MECHANICAL PENCIL

[75] Inventors: Mitsuo Maki, Tokyo; Tomohiro Hosoo, Chiba; Katsuyoshi Kikukawa, Koshigaya, all of Japan

[73] Assignee: Platinum Pen of America, Inc., Tex.

[21] Appl. No.: 261,987

[22] Filed: May 8, 1981

[30] Foreign Application Priority Data

Jul. 22, 1980 [JP] Japan ..... 55-102750

[51] Int. Cl.[4] ..... B43K 21/00; B43K 21/22

[52] U.S. Cl. ..... 401/65; 401/63; 401/53; 401/67; 401/116; 401/117; 24/11 P

[58] Field of Search ..... 401/116, 109, 77, 78, 401/79, 75, 65, 67, 63, 62, 94, 68, 74, 53, 117, 64; 24/11 P, 11 S

[56] References Cited

U.S. PATENT DOCUMENTS

| | | | |
|---|---|---|---|
| 1,720,471 | 7/1929 | Fritsch | 24/11 S |
| 2,491,061 | 12/1949 | Savoie | 401/74 |
| 2,533,513 | 12/1950 | Savoie | 401/78 |
| 2,627,246 | 2/1953 | Johnson | 401/77 X |
| 3,713,745 | 1/1973 | Horie | 401/94 |
| 4,172,673 | 10/1979 | Puchein | 401/65 |
| 4,269,524 | 5/1981 | Hashimoto | 401/67 X |

FOREIGN PATENT DOCUMENTS

| | | | |
|---|---|---|---|
| 859718 | 10/1952 | Fed. Rep. of Germany | 401/77 |
| 1926208 | 1/1970 | Fed. Rep. of Germany | 401/109 |
| 970151 | 1/1951 | France | 24/11 P |
| 1528054 | 4/1968 | France | 401/116 |
| 361077 | 11/1931 | United Kingdom | 401/78 |
| 954279 | 4/1964 | United Kingdom | 401/67 |

*Primary Examiner*—Steven A. Bratlie
*Attorney, Agent, or Firm*—Handal & Morofsky

[57] ABSTRACT

A mechanical pencil having a cylindrical barrel (1) and a sheath (2) in axial relationship is disclosed. A spiral member (4) in fixed relationship with the sheath and in axially sliding relationship with the barrel for a predetermined range engages a slider (7). The slider is in fixed relationship with a push feed type writing unit and slides axially within a predetermined range within the barrel (1) as allowed by a guide (3). First spring means is provided to urge the spiral member in a forward direction when the writing unit is positioned axially such that it is contained within the barrel (1). As the writing unit is moved from its rearmost position within the barrel (1) to a protruding position by rotation of the spiral member (4), a second spring means urges the spiral member in a rearward direction, forming a gap between the barrel (1) and the sheath (2). When the writing unit is in its protruding position the push-type feed mechanism is activated by forcing the sheath (2) forward, closing the gap between the barrel (1) and the sheath (2). An inventive pocket clip is provided which may be lockingly engaged flush with the surface of the sheath (2) or which can be raised into an in-use position by activating a high tension spring. In use, the forward portion (38) of the clip is forced away from the surface of the sheath by applying leveraging force. This allows clothing material to be frictionlessly positioned between the clip and the sheath surface.

6 Claims, 26 Drawing Figures

MECHANICAL PENCIL

TECHNICAL FIELD

The present invention relates to a mechanical pencil of the type in which lead is advanced by a push type lead feed.

BACKGROUND ART

The present invention relates to an improvement in a push type mechanical pencil having a push type lead feed mechanism adapted to be moved forwardly with respect to a barrel when the pencil is used, and a gap between the barrel and a sheath for conducting a push type lead feed operation.

DISCLOSURE OF THE INVENTION

In accordance with the present invention, a mechanical pencil comprises a spiral member fixedly fitted into a sheath such that the spiral member can be rotated with respect to a barrel and moved forwardly and backwardly in the axial direction within a predetermined range. A slider is fitted in the spiral member and adapted to be moved forwardly and backwardly in the axial direction within a predetermined range in accordance with the rotation of the spiral member. A joint is fixedly fitted into the front (or writing) end portion of the slider. A spring support ring is adapted to be slidingly moved within a predetermined range along the outer circumferential surface of the joint. A pair of springs are provided coaxially inside the barrel and are received by front and rear end surfaces, respectively, of a spring support ring. A writing unit provided with a push type lead feed mechanism is fixedly fitted into the front end portion of the joint.

BRIEF DESCRIPTION OF THE DRAWINGS

One way of carrying out the invention is described in detail below with reference to the drawings which illustrate only one specific embodiment of the invention in which.

DETAILED DESCRIPTION OF THE PREFERRED EMBODIMENT

Figure 1:
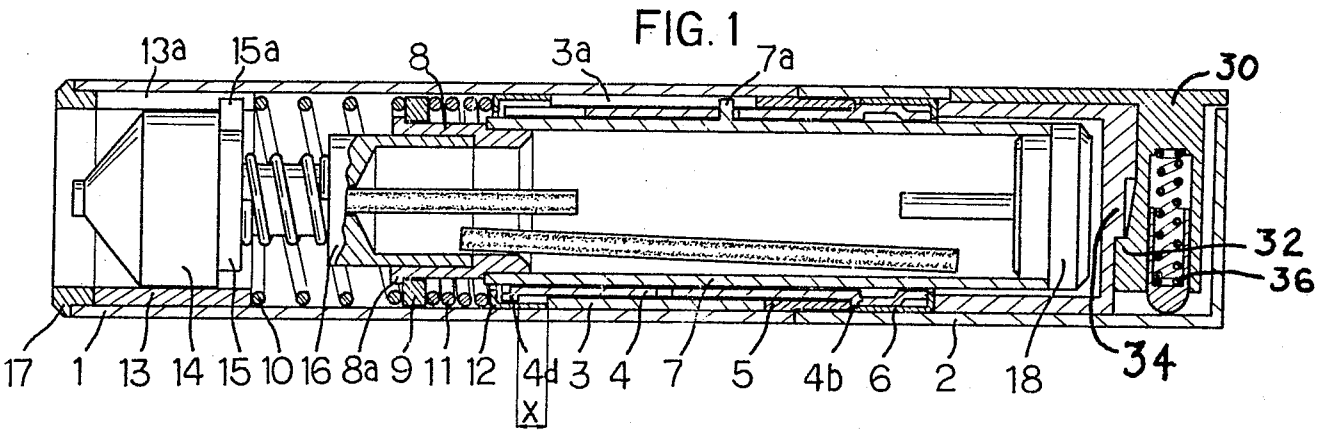
FIG. 1 is a side elevational view in section of a mechanical pencil embodying the present invention.
Figure 2:
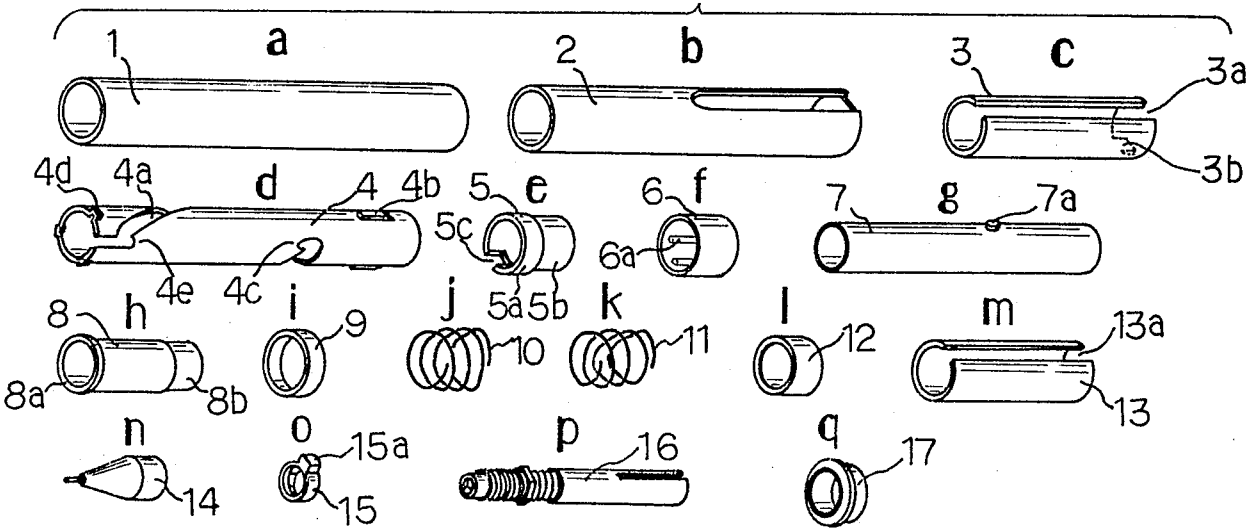
FIG. 2 represents perspective views of principal parts of the embodiment shown in FIG. 1.

In accordance with the present invention, a guide 3 having an axially extending slit 3*a* is fixedly fitted in the rear portion (the portion that is toward the writing end shall be called the front portion) of a barrel 1. A connecting tube 5 is fitted firmly under pressure at its front portion 5*a* into the rearmost portion of the guide 3 while engaging a projection 3*b* of the guide 3 with a recess 5*c* in the connecting tube 5 to prevent the guide 3 and connecting tube 5 from being rotated relative to each other. The connecting tube 5 is adapted to be loosely fitted at its rear portion 5*b* into a front end portion of a sheath 2.

An anti-rotation member 6 is fitted firmly under pressure inside a front portion of sheath 2. A spiral member 4 is fitted at its rear end portion into the anti-rotation member 6. Stepped portions 4*b* of the spiral member 4 engage with slits 6*a* in the anti-rotation member 6, so that the spiral member 4 can be rotated by turning sheath 2. When the sheath 2 is pulled backwardly, the sheath 2 and anti-rotation member 6 are removed from the spiral member 4.

The spiral member 4 is also engaged at the front edges of the stepped portions 4*b* with the rear edge of connecting tube 5 so as to support spiral member 4 against the forward tension of a rear spring 11. The spiral member 4 is loosely fitted in connecting tube 5 and guide 3, and has stepped portions 4*d* at its front end. The stepped portions 4*d* are spaced from the front edge of the guide 3 by a distance x when the mechanical pencil is not in use. While the mechanical pencil is used, the stepped portions 4*d* are engaged with the front edge of guide 3 so as to support the spiral member 4 against a backward pushing force caused by front spring 10.

The spiral member 4 is provided with a spirally extending slit 4*a*. A slider 7, which is loosely fitted in the spiral member 4, is provided with a pin 7*a*, which is fitted into the spiral slit 4*a* and further into the slit 3*a*. When spiral member 4 is rotated forwardly by turning sheath 2 clockwise, slider 7 is moved axially in the forward direction. When the spiral member 4 is rotated in the opposite direction by rotating sheath 2, slider 7 is moved axially in the opposite direction, since pin 7*a* is fitted into spiral slit 4*a* and axially extending slit 3*a*.

A joint 8 is fixedly fitted at is rear portion 8*b* into the front portion of slider 7. A lead pipe in a push type lead feed mechanism 16 is forcibly fitted into the front portion of joint 8. Joint 8 has a stepped portion 8*a* on the outer circumferential surface of its front end portion. A spring support ring 9 is loosely fitted around joint 8 and is capable of being slidingly moved between stepped portion 8*a* and the front edge of the slider 7.

The spring support ring 9 is adapted to receive front spring 10 at its front end surface and rear spring 11 at its rear end surface. The outer end of front spring 10 is received by a shoulder defined by the rear end of inner barrel 13, which is fixedly fitted in the front portion of barrel 1. The other end of rear spring 11 is received by the front end of spring support ring 12, which is fixedly fitted in an intermediate portion of barrel 1. When the mechanical pencil is not is use, rear spring 11 acts on spring support 9 to urge it against stepped portion 8*a* of joint 8. As a result slider 7 is drawn forward, so that pin 7*a* comes into engagement with slit 4*c* in spiral member 4. Consequently, spiral member 4 is drawn in the forward direction, and stepped portions 4*b* of spiral member 4 comes into engagement with the rear edge of connecting tube 5, so that spiral member 4 is fixedly supported. Sheath 2 is fitted at its front end around the rear portion 5*b* of connecting tube 5 in contact with the rear edge of barrel 1. Since slider 7 is supported in a rear position, push type feed mechanism and taper tip 14 are also in rear positions, hidden in barrel 1. When the mechanical pencil is in use, the front spring 10 acts on spring support ring 9 to elastically urge it against the front edge of slider 7, pushing slider 7 in the backward direction. Consequently, pin 7*a* comes into engagement with slit 4*e*, so that spiral member 4 is also pushed backwardly. As a result, stepped portions 4*d* of spiral member 4 come into engagement with the front edge of guide 3, fixedly supporting spiral member 4.

The push type lead feed mechanism 16 is of an ordinary construction. A taper tip 14 is screwed to the front portion of the lead feed mechanism 16, and taper joint 15 is loosely fitted around a portion of the lead feed mechanism 16 behind taper tip 14. The rear portion of a bore in taper joint 15 has a hexagonal cross section, so that taper joint 15 is fitted at its rear portion around the hexagonal nut portion of lead feed mechanism 16. Accordingly, taper joint 15 cannot be rotated relative to lead feed mechanism 16. Taper joint 15 is provided with an axially extending engagement projection 15*a* on its outer circumferential surface. Projection 15*a* is engaged with axial slit 13*a* provided in inner barrel 13, thereby preventing rotation of taper joint 15 and lead feed mechanism 16 relative to inner barrel 13.

A metal ring 17 is fixed to the front end portion of barrel 1 such that the rear end surface of ring 17 is in contact with the front end surface of inner barrel 13. Reference numeral 18 denotes a push element fitted into the rear end portion of slider 7.

Figure 16:
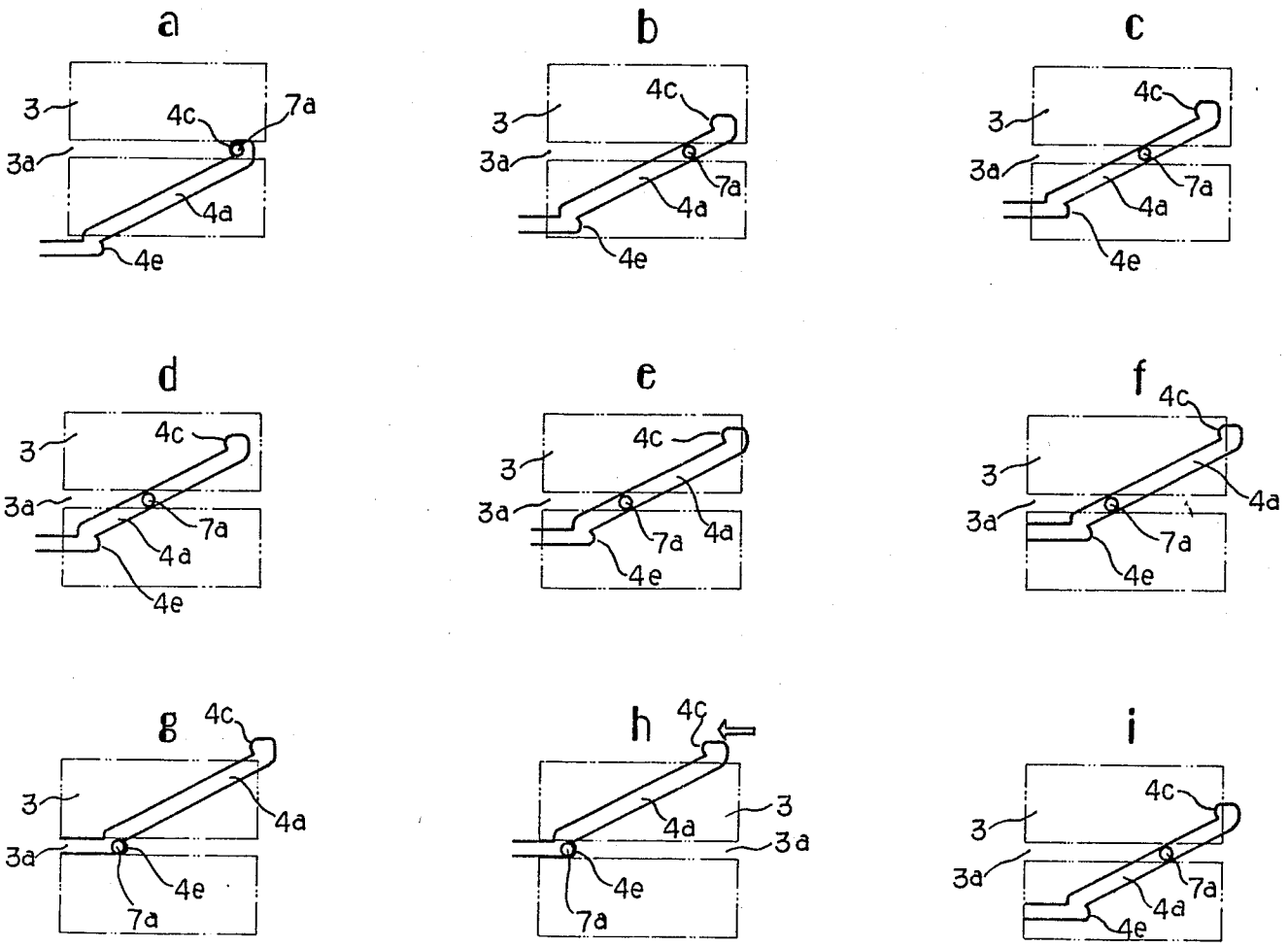
FIGS. 16*a*–16*i* represent plan views in section corresponding to FIGS. 4–11, which illustrate the positional relation between a guide, a spiral member and a projection provided on a slider, in various stages of the lead feeding operation.

When sheath sheath 2 is turned clockwise, spiral member 4 is rotated therewith via slits 6*a* in anti-rotation member 6. As a result, slider 7 is moved forwardly since pin 7*a* is fitted in spiral slit 4*a* as well as slit 3*a*. In accordance with the forward movement of slider 7, joint 8 is also moved forwardly and rear spring 11 is expanded gradually. Spring support ring 9 remains engaged with stepped portion 8*a* of joint 8 (refer to FIGS. 4 and 16*b*) until the resilient forces of rear spring 11 and front spring 10 are balanced with each other.

Figure 5:
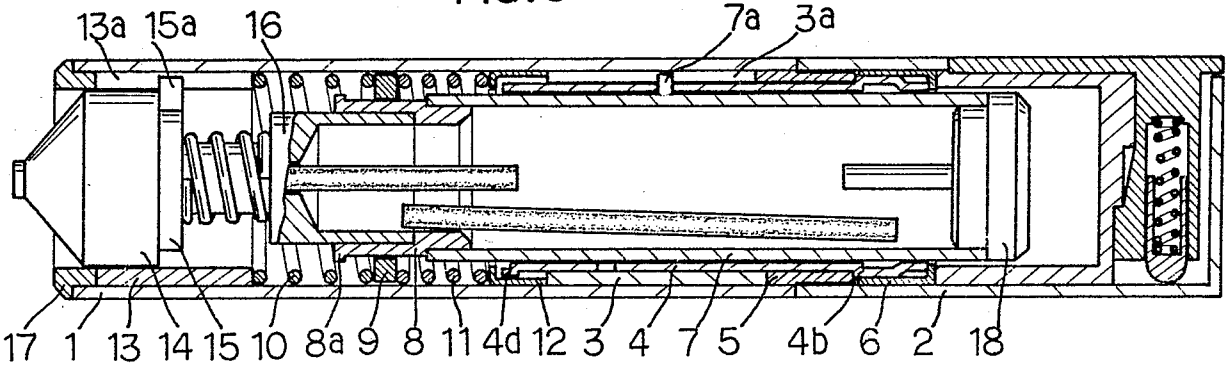
Figure 6:
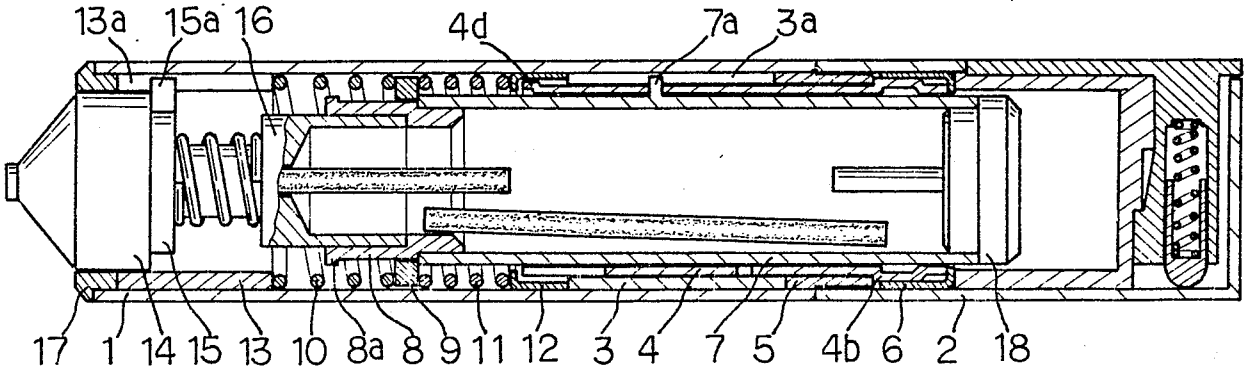

When sheath 2 is further turned, spring support ring 9 is moved in the backward direction, relative to joint 8 and along the outer circumferential surface of joint 8, (refer to FIGS. 5 and 16*c*) with the resilient forces of rear spring 11 and front spring 10 kept balance. Spring support ring 9 then comes into contact with the front edge of slider 7 (refer to FIGS. 6 and 16*d*).

When sheath 2 is further turned, spiral member 4 is moved backwardly with respect to barrel 1. The position of slider 7 is not changed with respect to barrel 1, since the balance of resilient forces of front and rear springs 10, 11 is not lost unless sheath 2 is pressed against barrel 1 with a large force.

Figure 7:
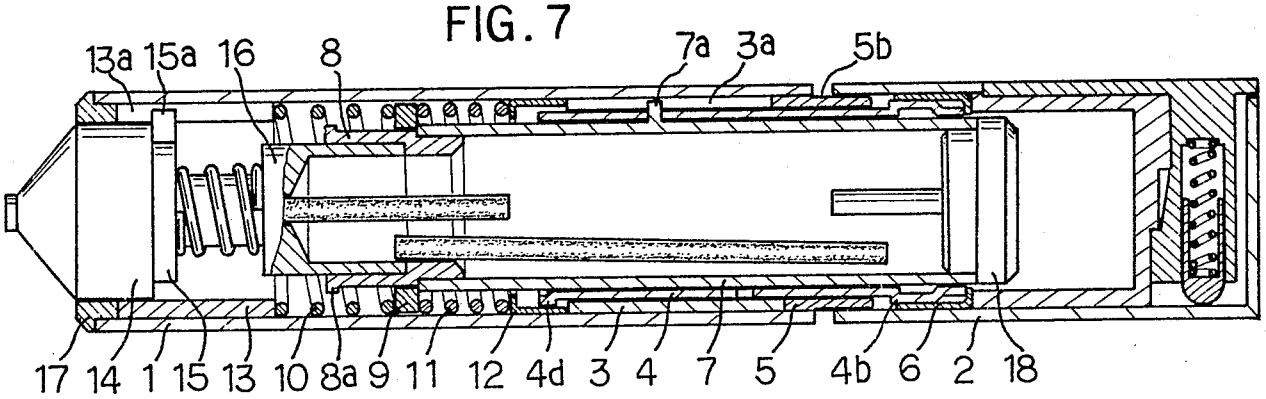

Consequently, sheath 2 is moved backwardly with spiral member 4, so that a gap is formed (refer to FIGS. 7 and 16*e*) between the rear edge of barrel 1 and the front edge of sheath 2. The stepped portions 4*d* of spiral member 4 then come into engagement with the front edge of guide 3 to form a gap x between the ear edge of barrel 1 and the front edge of sheath 2 (refer to FIGS. 8 and 16*f*).

Figure 9:
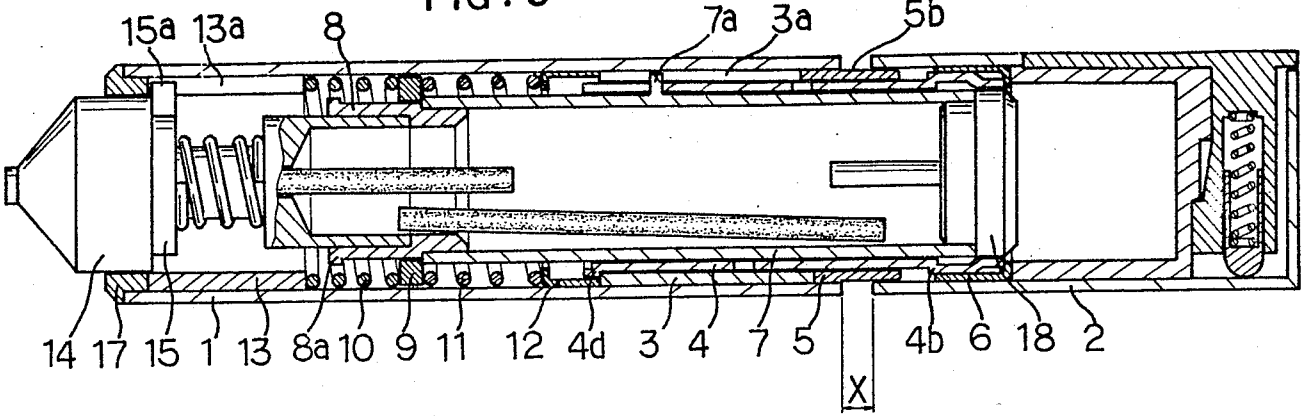

When sheath 2 is finally turned, stepped portions 4*d* of spiral member 4 come into engagement with the front edge of guide 3, so that spiral member 4 is not moved any further in the backward direction. Spring support ring 9 is then pushed forward by the front edge of slider 7, so that front spring 10 is compressed. As a result, pin 7*a* comes into engagement with slit 4*e* in spiral member 4, so that spiral member 4 is supported (refer to FIGS. 9 and 16*g*). When the spiral member 4 is in this position, the taper tip 14 is projected forwardly from metal ring 17, so that the mechanical pencil is ready to be used.

Figure 10:
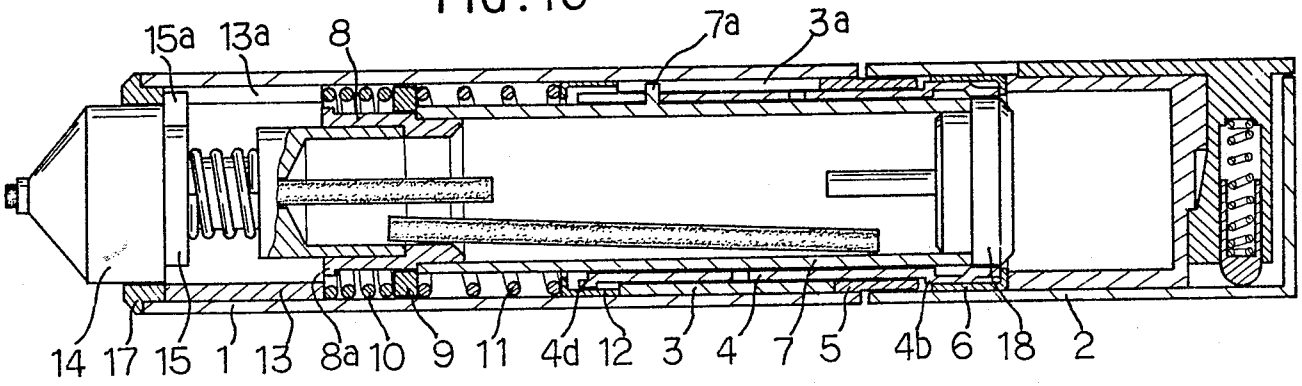

In order to feed a lead, the rear end portion of sheath 2 is pushed forward. This urges slit 4*e* on spiral member 4, containing pin 7*a*, in a forward direction. As a result, the lead pipe in the push type lead feed mechanism 16 is pushed via joint 8 against a spring, and taper joint 15 comes into engagement with metal ring 17. This allows taper tip 14 to be supported in a fixed position, and results in feeding lead through taper tip 14 (refer to FIGS. 10 and 16*h*).

Figure 8:
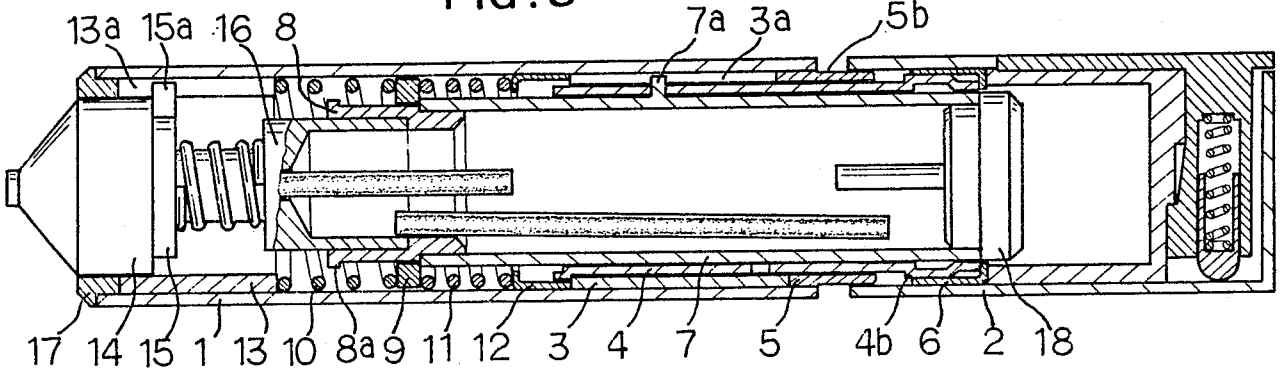
Figure 11:
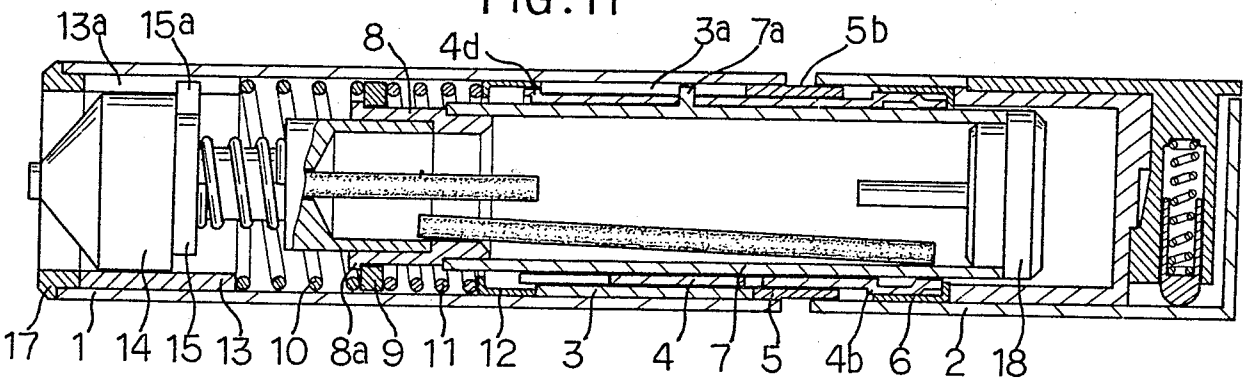
Figure 12:
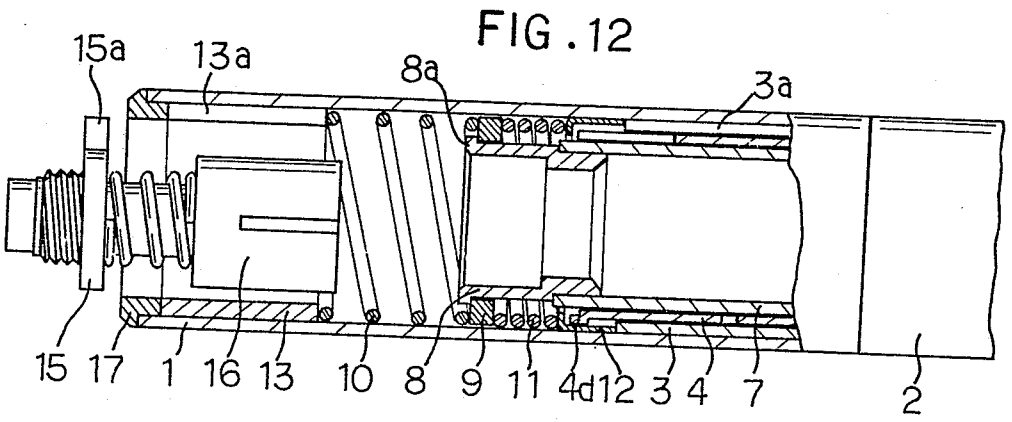
FIGS. 12–15 are side elevational views of a principal portion of the embodiment shown in FIG. 1, which illustrate the procedure for setting a push type lead feed mechanism and a taper tip in a barrel thereof.
Figure 13:
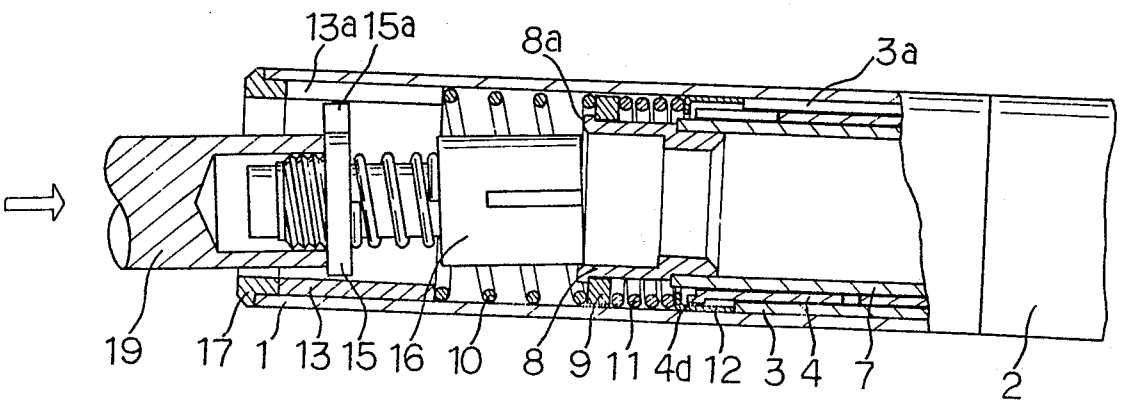
Figure 14:
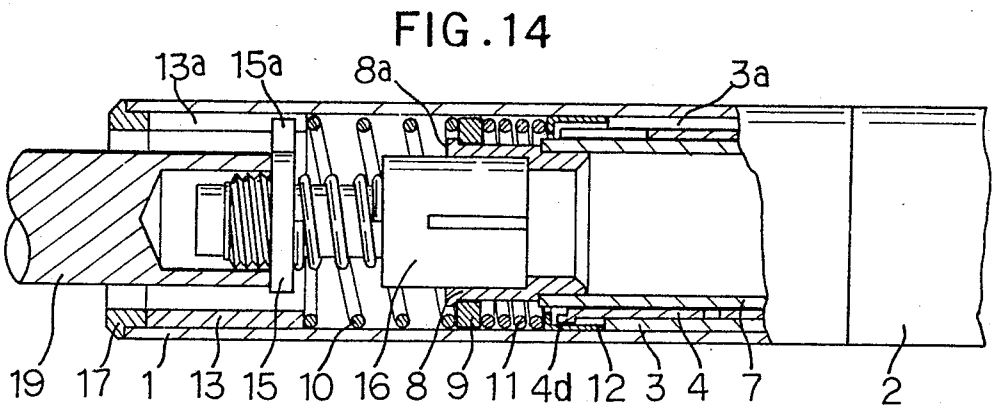
Figure 15:
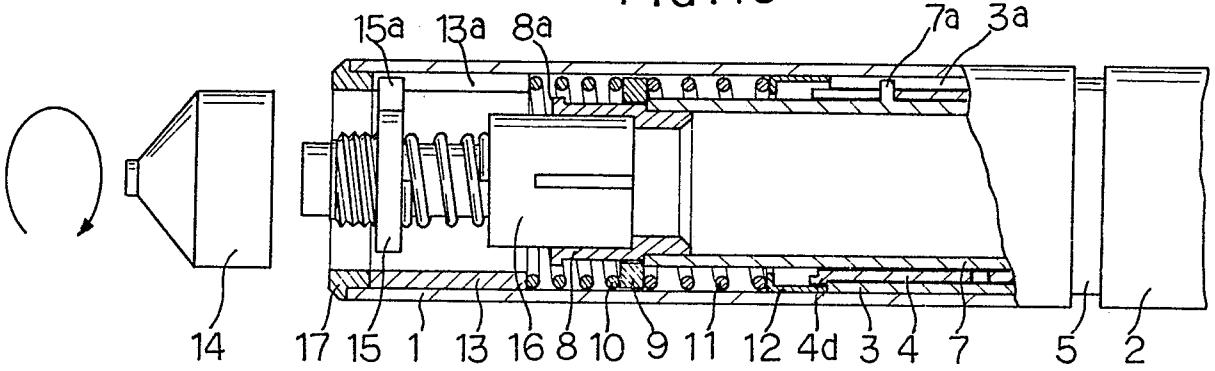

In order to retract taper tip 14 into barrel 1, sheath 2 is turned counter-clockwise. As a result, pin 7*a* on slider 7 is disengaged from slit 4*e* in spiral member 4, and slider 7 is moved backwardly due to the fitting relation between slit 4*a* in the spiral member 4, pin 7*a* on slider 7 and slit 3*a* in guide 3. At this time, front spring 10 is expanded. Spring support ring 9 remains to be engaged with the front edge of slider 7 (just as shown in FIG. 8) until the resilient forces of front and rear springs 10, 11 have been balanced. When sheath 2 is further turned, slider 7 is moved backwardly, and spring support ring 9 is supported by front and rear springs 10, 11 (which are in a balanced state) so that joint 8 is moved in the backward direction. Spring support ring 9 then comes into engagement with stepped portion 8*a* of joint 8 (refer to FIGS. 11 and 16*i*).

Figure 4:
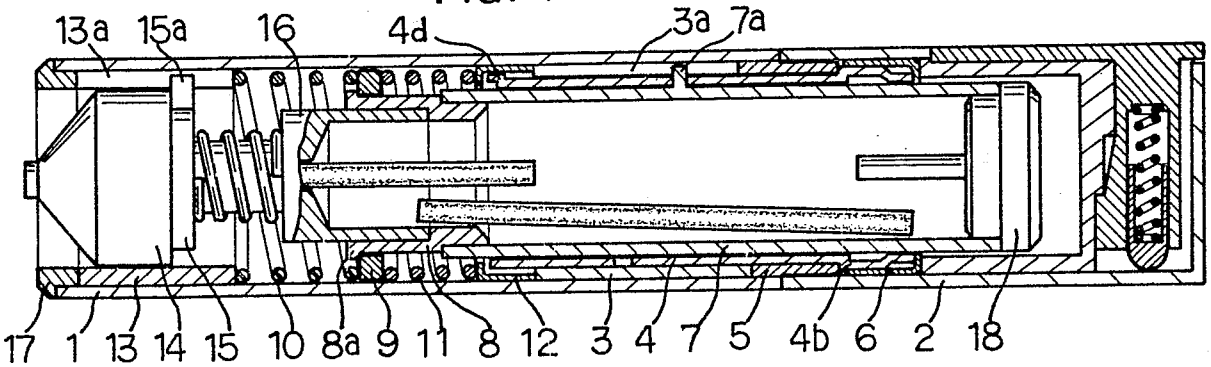
FIGS. 4–11 are side elevational views of the embodiment shown in FIG. 1, which illustrate the operation thereof.

When sheath 2 is further turned, spiral member 4 is moved forwardly with slider 7 remaining in the same position since the spring support system stays in the same position owing to the balance of springs 10 and 11. Consequently, sheath 2 is moved forwardly to come into contact at its front edge with the rear edge of barrel 1 (just as shown in FIG. 4). When sheath 2 is further turned, slider 7 is moved backwardly again to compress rear spring 11. Finally, pin 7*a* comes into engagement with slit 4*c* in the spiral member 4 to support spiral member 4 in the position and return to the state shown in FIG. 1.

The writing portion consisting of the push type lead feed mechanism 16 and taper tip 14 can be freely set in and removed from barrel 1, and is not shifted while the mechanical pencil is in use. The explanation is that the lead pipe is fitted under pressure deep into joint 8 with projection 15*a* on taper joint 15 engaged with slit 13*a* in inner barrel 13. The trunk portion of taper tip 14 is designed such that, when taper tip 14 is slidingly moved, the outer circumferential surface of the trunk portion thereof closely contacts the inner circumferential surfaces of metal ring 17 and inner barrel 13.

FIGS. 12–15 illustrate the procedure for setting the push type lead feed mechanism 16 and taper tip 14 in barrel 1. First, the push type lead feed mechanism 16 is inserted, using a tool 19, into barrel 1 to connect the lead pipe to joint 8. Taper tip 14 is then screwed to the lead feed mechanism 16. The insertion of push type lead feed mechanism 16 is carried out with the pencil body in a not-in-use mode, while the screwing of the taper tip 14 is carried out with the pencil body in an in-use mode. The diameter of taper joint 15, including the height of engagement projection 15*a* provided thereon, is slightly smaller than the inner diameter of metal ring 17. Accordingly, the lead feed mechanism 16 can be inserted into and removed from barrel 1 without trouble. On the inner side of metal ring 17, projection 15*a* is fitted into slit 13*a* in inner barrel 13 to allow the axis of the lead feed mechanism 16 to be aligned with that of barrel 1.

Since projection 15*a* on taper joint 15 is engaged with slit 13*a* in inner barrel 13, taper tip 14 can be screwed on and removed without causing the lead feed mechanism 16 to be rotated.

In accordance with the present invention, the writing portion of the mechanical pencil can be extended outside barrel 1 by turning sheath 2. Turning sheath 2 creates a gap between barrel 2 and sheath 2 for a lead feeding operation. The lead feeding operation is accomplished by pushing sheath 2 towards barrel 1, utilizing the gap previously formed. When sheath 2 is turned in the opposite direction, the writing portion is retracted and the gap between barrel 1 and sheath 2 is closed. If the writing portion is kept retracted in the barrel while the mechanical pencil is not in use, the mechanical pencil can be carried in a completely cylindrical state. Therefore, the mechanical pencil according to the present invention, with the writing portion retracted in the barrel, has no pointed portions. This is unlike conventional mechanical pencils. Without pointed portions the mechanical pencil is not caught by clothes and does not hurt fingers. Moreover, if the mechanical pencil should be dropped, the tapered tip 14 will not be broken. The writing portion of this mechanical pencil can be kept stable both while it is used and while it is stored. Since the tapered tip can be easily set in and removed from the barrel, a lead can be removed easily when it has been broken in the taper tip by unduly great shock received while the pencil was in the in-use mode.

Figure 3A:
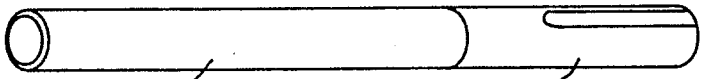
FIG. 3*a* is a perspective view of the embodiment shown in FIG. 1, in a not-in-use mode.
Figure 3B:
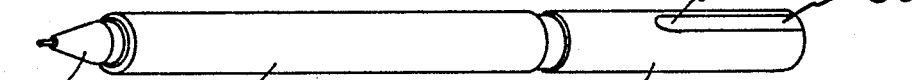
FIG. 3*b* is a perspective view of the embodiment as shown in FIG. 1, in an in-use mode.

A pocket clip 30 as shown in FIGS. 1 and 3(*b*) is provided. As shown in FIG. 1, pocket clip 30 is lockingly engaged in a position flush with the surface of sheath 2 due to the engagement of locking tab 32 and protruding edge 34 of the body of sheath 2 to resist the outward radial force of high tension spring 36. Pocket clip 30 can also assume the position shown in FIG. 3*b* in which position it is maintained by spring 36.

We claim:

1. A mechanical pencil, comprising:

(a) a barrel having an open, flat frontal end;

(b) sheath means disposed axially adjacent to said barrel at the rear end thereof;

(c) cam means positively engaging said sheath means, said cam means having a camming surface mounted for rotation and for movement forwardly and backwardly in an axial direction within a predetermined range with respect to said barrel;

(d) slider means fitted in said cam means;

(e) support means fixedly fitted onto the front end of said slider means;

(f) writing unit means provided with a push type lead feed mechanism fixedly fitted into the front end portion of said support means;

(g) cam engagement means on said slider means for engaging said camming surface, said camming surface being configured and dimensioned to move said slider means from a first position wherein said writing unit means fixed thereto through said support means is entirely contained within said barrel to a second position wherein said writing unit means fixed thereto through said support means protrudes from said frontal end of said barrel;

(h) first spring means to urge said cam means toward said frontal end of said barrel when said writing unit means is in said first position, thereby urging said sheath means into close-fitting relationship with said barrel; and (i) second spring means to urge said cam means backwardly within said barrel when said writing unit means is in said second position, thereby urging said sheath means into spaced axial relationship with said barrel.

2. A mechanical pencil as in claim 1, wherein said writing unit means has a tapered tip fixedly fitted at the front end portion thereof, the outer circumference of said tapered tip fitting in close to the inner circumference of said barrel.

3. A mechanical pencil as in claim 2, further comprising a pocket clip at the rear end of said sheath means, said pocket clip assuming a first position flush with the surface of said sheath means and assuming a second position wherein the rear portion of said pocket clip is springingly forced radially outward from the surface of said sheath means and assuming a third position wherein the frontal portion of said pocket clip is radially away from the surface of said sheath means at the same time that said rear portion of said pocket clip is radially away from the surface of said sheath means.

4. A mechanical pencil comprising:

(a) a barrel having an open, flat frontal end;

(b) cam means having a camming surface mounted for rotation, and movement forwardly and backwardly in an axial direction within a predetermined range with respect to said barrel;

(c) slider means fitted in said cam means;

(d) writing unit means provided with a push type lead feed mechanism fixedly fitted into the front end of said slider means;

(e) actuator means secured to said cam means;

(f) rotation preventing means secured to said barrel to prevent rotation of said slider means with respect to said barrel;

(g) cam engagement means on said slider means for engaging said rotation preventing means and said camming surface, said surface and said rotation preventing means being configured, dimensioned and positioned to move said slider means forwardly and backwardly in the axial direction between a first position where said writing unit means is within said barrel and said actuator means is adjacent said barrel, and a second position where said writing unit means extends from said barrel and said actuator means is separated from said barrel, in response to rotation of said cam means; and (h) coupling means for coupling mechanical movement of said actuator means toward said barrel to said writing unit to operate said lead feed mechanism.

5. A mechanical pencil as in claim 4, wherein said camming surface is further configured to place said barrel adjacent said actuator means in said first position and to move said actuator means away from said barrel in said second position and further comprising spring means for urging said actuator means into such position away from said barrel when said cam engagement means is in said second position.

6. A mechanical pencil as in claim 5, further comprising a pocket clip at the rear end of said actuator means said pocket clip assuming a first position flush with the surface of said actuator means and assuming a second position wherein the rear portion of said pocket clip is springingly forced radially outward from the surface of said actuator means and assuming a third position wherein the frontal portion of said pocket clip is radially away from the surface of said actuator means at the same time that said rear portion of said pocket clip is radially away from the surface of said actuator means.

* * * * *